United States Patent [19]

Macnab

[11] 3,951,065

[45] Apr. 20, 1976

[54] EXPLOSIVE DEVICE AND METHOD FOR REMOVING ICE FROM RAILROAD TUNNELS

[76] Inventor: Loren E. Macnab, c/o Peter Macnab, Star Rte., Wasco, Oreg. 97065

[22] Filed: Jan. 27, 1975

[21] Appl. No.: 544,233

[52] U.S. Cl. ..... 102/22; 102/23

[51] Int. Cl.[2] ..... F42D 3/00

[58] Field of Search ..... 134/1, 5, 42; 166/63; 299/13, 24; 102/22–24

[56] References Cited

UNITED STATES PATENTS

| | | | |
|---|---|---|---|
| 2,790,388 | 4/1957 | MacLeod | 166/63 |
| 3,632,172 | 1/1972 | Robinson et al. | 299/13 |
| 3,800,703 | 4/1974 | Murokami | 102/22 |

FOREIGN PATENTS OR APPLICATIONS

| | | | |
|---|---|---|---|
| 32,558 | 10/1970 | Japan | 102/23 |
| 360,089 | 8/1962 | Switzerland | 102/23 |

*Primary Examiner*—Verlin R. Pendegrass
*Attorney, Agent, or Firm*—Chernoff & Vilhauer

[57] ABSTRACT

An explosive device for use in removing ice formed in railroad tunnels and similar underground cavities comprising a base member and mating cap member assembled to form a rigid blast-directing assembly having a groove formed around its periphery at the juncture between the base and cap members, and a ring-shaped explosive substance, detonable by an electric charge, seated therein. The peripheral groove is of sufficient depth and width that any explosive gases and heat produced therein will be directed radially outward from all sides of the assembly in a relatively thin, fan-like pattern. In use, a plurality of the devices are fastened in clusters to the interior wall and ceiling surfaces of a railroad tunnel or other underground cavity at those points where water seeping into the cavity is likely to freeze into ice. Whenever the ice accumulates to a thickness protruding beyond a predetermined distance from the interior surface of the cavity, the explosive substance seated in the groove around one or more selected assemblies may be detonated by the application of a remotely-generated electric charge to shear away the protruding ice. As the ice reforms, the explosive substance within different assemblies may be detonated, thereby keeping the cavity relatively ice-free over extended periods of time.

11 Claims, 7 Drawing Figures

EXPLOSIVE DEVICE AND METHOD FOR REMOVING ICE FROM RAILROAD TUNNELS

BACKGROUND OF THE INVENTION

This invention relates to means for removing the accumulations of ice that commonly form over the walls and ceilings of railroad tunnels and other unheated underground cavities during prolonged periods of freezing temperatures. It is a common occurrence in railroad tunnels that underground water seeps into the interior of the tunnel through cracks along the walls and ceilings. As long as the temperature in the tunnel remains above freezing, this water runs harmlessly down the walls of the tunnel and either seeps back into the ground through the floor of the tunnel or drains out the ends of the tunnel. However, during those times of the year when the temperature within the tunnel drops below freezing for prolonged periods of time, the water seeping into the tunnel will freeze upon being exposed to the frigid air and form thick accumulations of ice along the ceiling and walls of the tunnel. Unless this ice is periodically removed, it can grow to sufficient dimensions that its weight and internally generated pressures threaten the stability of the tunnel itself. In addition, the accumulated ice may enlarge until it protrudes from the surface of the tunnel a distance sufficient to interfere with the safe passage of trains.

Normally, these accumulations of ice are removed periodically from the ceiling and walls of the tunnel by railroad crews laboriously chipping the ice away with picks or other hand tools. This method of removing the ice is both time consuming and expensive, and requires that the crews work within the tunnel for long hours during those times of the year when the temperature is at its lowest point and when the tunnel itself is least accessible.

SUMMARY OF THE INVENTION

The present invention is directed to a means for explosively removing ice accumulations from along the ceiling and walls of a railroad tunnel or other unheated underground cavity. More particularly, the device comprises a rigid, blast-directing assembly having a ring-shaped explosive substance seated within a groove formed around its periphery. The assembly includes a base member fastenable to the interior surface of the cavity and a mating cap member fastenable to the base member. The peripheral groove housing the ring-shaped explosive substance is formed at the juncture between the base and cap members such that one side of the groove is formed in the base member and the other side is formed in the cap member, thus permitting the interior of the groove to be exposed when the base and cap members are disassembled. This in turn permits the explosive substance to be formed in a continuous ring and inserted into the groove after the base member has been fastened to the cavity surface, without stretching or separating the explosive ring, simply by removing the cap member from the base member, placing the explosive ring in the base member side of the groove and refastening the cap member without requiring that the base member be removed from the cavity surface. The explosive substance itself is of a type that is relatively unaffected by shock or heat, yet readily detonable by the direct application of an electrical charge. An electrically insulating interface is interposed between the base and cap members so that the electrical charge necessary to detonate the explosive substance seated within the groove may be applied directly to the substance by impressing an electrical potential across the groove, for example, by applying a voltage differential to the base and cap members respectively.

The peripheral groove formed around the assembly is of sufficient depth and width that, when the explosive substance seated therein is detonated, the groove will have a nozzle-like effect on the gases and heat produced by the resulting explosion, constraining and directing them radially outward from the device in a relatively thin, fan-like pattern. When the device is fastened to the surface of the cavity, this pattern of radiating gases and heat will be separated from the cavity surface by a distance substantially equal to the thickness of the base member, or approximately one-half to one inch, thereby permitting electrical conductors to be permanently connected to the device and routed therefrom along the surface of the cavity to a remote source of electrical energy without danger of the conductors being damaged or blown loose by the gases and heat radiating from the groove. Thus, once the device has been fastened to the interior surface of the cavity and its electrical conductors connected, it may be reused indefinitely simply by unscrewing the cap member from the base member without disturbing the electrical conductors, reinserting a new explosive ring and refastening the cap member, the latter operation automatically reconnecting the cap member to the remote source of electrical energy. Because this reloading operation may be performed without removing the base member or disturbing the conducters employed to deliver the electrical potentials to either the base member or the cap member, it may be carried out safely and quickly by persons minimally trained in the use of explosives.

An alternate embodiment of the ice removing device having an angled base and cap member and a correspondingly angled peripheral groove is provided for attachment to the cavity surface at the juncture between a vertical wall and a sloping ceiling.

In use to prevent dangerous ice accumulations from forming within an unheated underground cavity, for example, a railroad tunnel, a plurality of the explosive devices of the present invention are clustered throughout the tunnel at those points where ice is likely to form and the electrical conductors from the base and cap members are connected independently or in selected groups to a remote source of electrical energy. When the ice accumulates at any point over the interior surface of the tunnel to a thickness sufficient to require its removal, the explosive substances of a selected number of the devices at that point may be detonated, usually sequentially rather than concurrently to avoid damage to the tunnel formation. The resultant gases and heat, emanating from the peripheral grooves of the selected devices in fan-like patterns substantially parallel to the surface of the tunnel, will shear away the accumulated ice which protrudes from the tunnel surface a distance beyond the edge of the groove. The spacing of the devices within each cluster and the spacing between the clusters themselves are such that the detonation of the explosive substance of selected devices will completely dislodge the ice without damaging the tunnel foundation or other nearby unselected devices. The layer of ice remaining between the plane of the groove and the surface of the cavity serves to shield the conductors connecting both the selected and nonselected devices to the remote source of electrical energy from damage by the exploding selected devices and is not sufficiently large to create a hazard to either the tunnel or to trains passing therethrough.

By using an explosive substance that is detonable by a direct electrical charge, yet relatively unaffected by shock, heat or static electricity, it is possible to detonate the explosive substance of selective devices in close proximity with other similar devices without causing the explosive substance of the non-selected devices to be also detonated. In addition, the explosive substance is relatively safe under normal conditions in that it is not likely to be accidentally detonated by handling or while it is being seated in the peripheral groove between the base and cap members or while high ambient static electricity conditions are present.

As the explosive force of the detonated substance is directed radially outward from each selected device in a thin highly concentrated, fan-like pattern, a relatively large area of the tunnel interior may be cleared of accumulated ice by the detonation of a relatively small explosive charge at relatively few points. This often enables a sufficient number of the devices of the present invention to be placed within the tunnel before the onslaught of freezing temperatures to keep the tunnel clear of ice throughout the season of ice formation. Thus, work crews may install the devices and connect them to the remote source of electrical energy during the warmer months when working conditions are more satisfactory and when the tunnels are more readily accessible. In addition, the use of a relatively small explosive charge to dislodge ice that has accumulated over a relatively large area of the tunnel interior permits a quantity of explosives to be used that is sufficiently small so as not to jeopardize the structural integrity of the tunnel. The layer of ice remaining after each explosion is of a thickness not sufficiently heavy nor capable of producing internally generating pressures sufficient to cause damage to the tunnel interior.

Moreover, as neither the device itself nor the conductors carrying the electrical detonating charge will be significantly damaged by the detonation of the explosive substance, both may be reused by simply removing the cap member and replacing the ring of explosive substance.

It is, therefore, a principal objective of the present invention to provide a safe, efficient and economical means for repeatedly removing ice accumulating beyond a predetermined thickness over the interior surfaces of a railroad tunnel or other unheated underground cavity.

It is an additional objective of the present invention to provide a means for removing accumulated ice from the interior of a railroad tunnel or other unheated underground cavity whereby said means may be placed within the tunnel during a period of warm weather to keep the tunnel free of dangerous ice accumulations throughout a prolonged period of freezing temperature.

It is a principal feature of the present invention that the explosive substance seated in the peripheral groove around each device may be detonated in proximity with other similar devices without causing their subsequent detonation and may be readily replaced after it has been exploded, thereby permitting the device to be reused.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
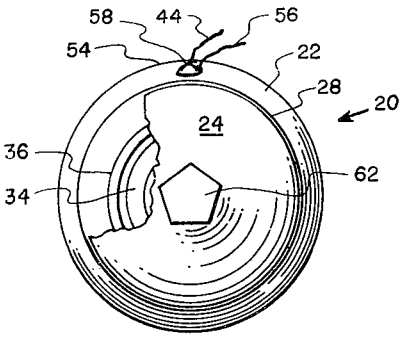
FIG. 1 is a partially cut away plan view of one embodiment of the ice removing device of the present invention.
Figure 2:
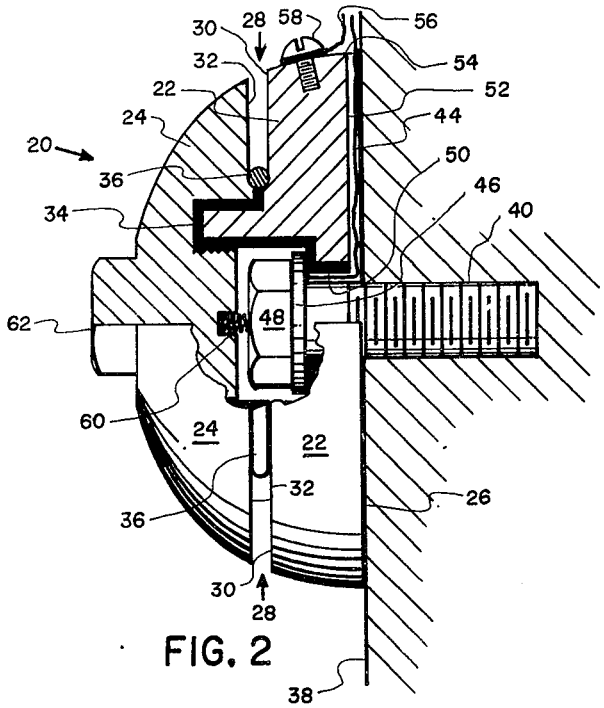
FIG. 2 is a partially sectioned elevation of the embodiment of the ice removing device of the present invention shown in FIG. 1.

Referring to FIGS. 1 and 2, the ice removing device of the present invention is seen to comprise a hemispherically shaped assembly, indicated generally as 20, including a base member 22 and a cap member 24 of rigid, shock resistant, electrically conductive material. The hemispherical outline of the assembly is unimportant to the invention and other shapes may be employed. Formed around the assembly at the juncture of the base and cap members, and parallel to the substantially planar back surface 26 of the base member, is an outwardly facing peripheral groove 28. One side 30 of this groove is formed in base member 22 and the other side 32 is formed in cap member 24 such that the interior of the groove will be exposed when the cap and base members are separated. Interposed between the base and cap members is an insulating member 34 of rigid, shock resistant, electrically nonconductive material. This member is preferably bonded to the base member or otherwise affixed thereto to permit the firm, threaded engagement of the cap member as shown in FIG. 2. Seated in the peripheral groove formed between base member 22 and cap member 24 is a plastic, ring-shaped explosive substance 36 that is relatively unaffected by shock or heat, yet readily detonable by the application of a direct electrical charge.

Figure 3:
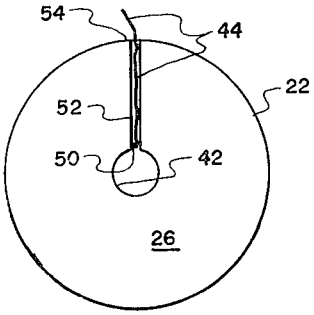
FIG. 3 is a back view of the embodiment of the ice removing device shown in FIG. 2.

The base member 22 is fastenable to a substantially planar surface 38, such as the interior wall or ceiling surface of a railroad tunnel, by inserting an elongate bolt 40 through a bore 42, best seen in FIG. 3, formed in the center of the base member and threading the bolt into the surface. The insulating member 34 employed to electrically separate the base and cup members when assembled, is carried through the bore 42 to similarly insulate the bolt 40 from the base member 22. An electrical conductor 44 attached to a metal washer 46 fitted around the bolt 40 near its head 48 is routed from the washer through a keyway 50 formed in the side of the bore 42 and through a groove 52 formed in the back surface 26 of the base member to the periphery 54 of the base member for use as described below. A second electrical conductor 56 is attached to the base member itself by wrapping the conductor around a screw 58 threaded into the base member.

The cap member 24 is fastenable to the base member 22 by threaded engagement with the insulating member 34 bonded to the base member. A spring-biased contact 60 attached to the cap member and forced against the bolt head 48 when the cap member is fastened to the base member serves to achieve electrical continuity between the cap member and the bolt 40 holding the base member to the tunnel surface thus permitting the cap member to be removed from the base member and refastened thereto without disturbing the electrical conductors 44 and 56. A pentagonal bolt-head like protrusion 62 formed in the cap member facilitates fastening the cap member to the base member and also inhibits its unauthorized removal with conventional tools.

Figure 4:
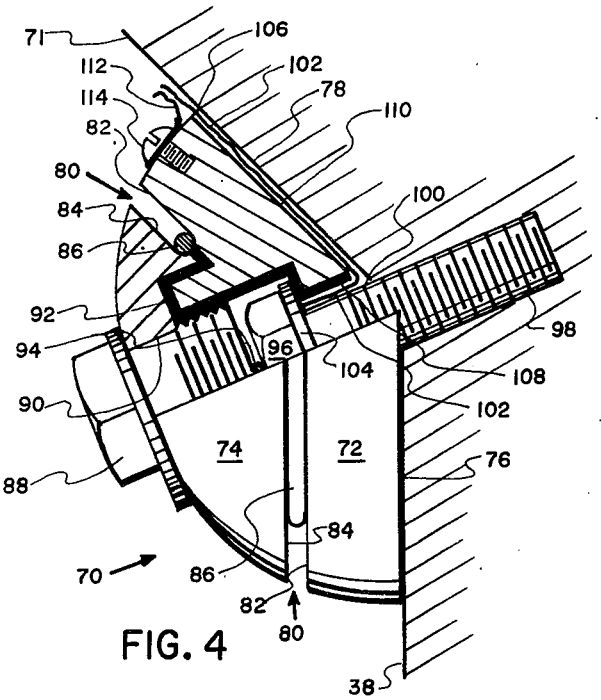
FIG. 4 is a partially sectioned elevation of an alternative embodiment of the ice removing device of the present invention.
Figure 6:
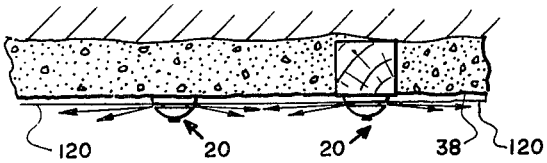
FIG. 6 is a detail view taken along line 6—6 of FIG. 5.
Figure 7:
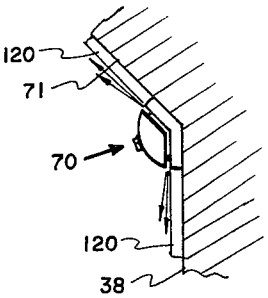
FIG. 7 is a detail view taken along line 7—7 of FIG. 5.

An alternate embodiment of the ice removing device of the present invention, indicated generally as 70 in FIG. 4, adapted for attachment to a tunnel surface at the juncture between a vertical wall 38 and a sloping ceiling 71 differs from the previous embodiment mainly by the shape of its base member 72 and cap member 74 and by the means employed to attach the cap member to the base member. As seen in the figure, the back surface of the base member defines two substantially flat planes 76 and 78 intersecting one another at an angle along an imaginery line through the back surface. The peripheral groove 80 formed at the juncture between the cap and base members is similarly angled to be parallel along part of its length to back plane 76 and parallel along the remainder of its length to back plane 78. Similar to the first embodiment described earlier, one side 82 of this groove is formed in base member 72 and the other side 84 is formed in cap member 74. Also similar to the first embodiment, a plastic ring-shaped explosive substance 86 that is relatively unaffected by heat and shock, yet readily detonable by an electric charge, is seated in the groove 80.

Because the V-shape of the base member 72 and cap member 74 prevents the simple threaded engagement of the cap member to the base member, a short, pentagonal-headed bolt 88 inserted through a bore 80 formed in the cap member is threaded into the insulating member 92 bonded to the base member to removably fasten the cap member thereto. A spring-biased contact 94 attached to the bolt 88 and pressed against the head 96 of the elongate bolt 98 employed to fasten the base member 72 to the interior surface of the tunnel electrically connects the short bolt 88 and therefore the cap member to the elongate bolt 98. As with the first embodiment, an electrical conductor 102 is connected to a washer 104 and fitted around the elongate bolt 98 and routed to the periphery 106 of the base member via a keyway 108 formed in the side of bore 100 and a groove 110 formed in the back plane 78, and a second electrical conductor 112 is attached to the base member by screw 114.

Figure 5:
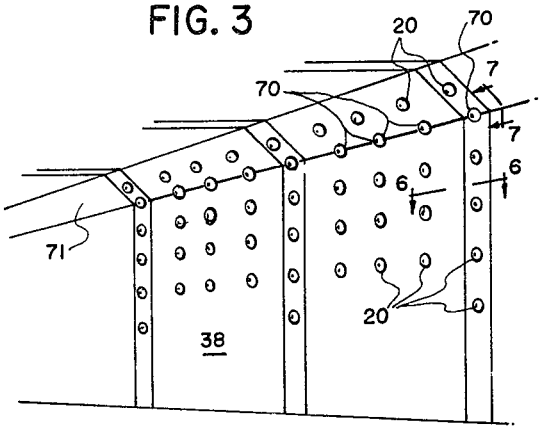
FIG. 5 is a perspective view of the interior of a railroad tunnel showing a plurality of the devices of FIGS. 2 and 4 attached to the wall of the tunnel in clusters.

To explosively remove ice accumulations from the interior surface of a railroad tunnel or other underground cavity, a plurality of base members are fastened by the elongate bolts through the respective centers of their base members to the surface of the cavity in clusters, as shown in FIG. 5, at those points where ice is likely to form. Devices 20 with their substantially flat back surfaces are employed along the walls and ceilings while devices 70 with their angled back planes are employed at the junctures between the walls and ceilings. Next, the pair of conductors attached to each device is connected, individually or in groups with pairs of conductors from other devices, to a remote source of electrical energy. These conductors may be fastened along the surface of the tunnel without fear of their being damaged by the exploding devices for reasons described below. Finally, a ring of explosive substance is placed in the half groove of each base member and the cap members are fastened and secured. Because of the insulating member interposed between each base and cap member and between the elongate mounting bolt and the base member, any electrical potential impressed across the conductor pair connected to a particular device, for example, conductors 44 and 56 of device 20, will create a similar difference in potential between the base and cap members 22 and 24 of that device. The spring-biased contact 60 will transfer the electrical potential of the elongate mounting bolt 40 to the cap member. More particularly, a difference in potential, or electrical charge, will be impressed across the explosive substance 36 seated in the groove 28 causing the substance to explode. The width and depth dimensions of the peripheral groove 28 are such that the gases and heat produced by the exploding substance seated therein will be constrained and directed to radiate outwardly in a relatively thin fan-like pattern. For the angled groove 80 of the alternate embodiment 70, the gases and heat eminating from each half of the device will similarly radiate outwardly in a thin fan-like pattern angled to match the shape of the groove. With either embodiment, this fan-like pattern of expanding gases and heat will be substantially parallel to the surface of the tunnel over which it is traveling. The distance between these radiating gases and heat and the tunnel surface is determined by the thickness of the base member and should be approximately one-half to one inch.

As water seeping into the tunnel freezes into ice and this ice begins to accumulate, selected devices within selected clusters may be detonated to shear away the ice that is protruding further from the tunnel surface than the peripheral groove around each device. The electrical conductors employed to carry the electrical charge to the explosive substance within the selected devices will be protected from damage by the distance between the radiating gases and heat and the surface of the tunnel to which the conductors are attached. In addition, the approximately one-half to one inch thick layer of ice 120 remaining on the tunnel surface after the selected devices have been detonated offers further protection for these conductors. The explosive substance employed, due to its resistance to shock and heat, will prevent nonselected devices within selected clusters from being unintentionally detonated by the detonation of the adjacent selected devices.

As the ice reforms, different devices within each cluster may be detonated, thereby keeping the tunnel relatively free of ice for extended periods of time. When all of the devices have been detonated, they may be reloaded simply by removing the cap member, inserting a new ring of explosive substance into the base member and fastening the cap member without disturbing the conductors connecting the device to the remote source of electrical energy.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An explosive device, for removing accumulated ice from the interior surfaces of a railroad tunnel or other underground cavity, comprising:

a. a rigid, shock-resistant, blast-directing assembly including a base member and mating cap member and having means defining an outwardly facing groove around its periphery at the juncture between the base and cap members;

b. first fastening means for attaching said base member to the interior surface of an underground cavity;

c. second fastening means for attaching said cap member to said base member;

d. an explosive substance formed in the shape of a loop and captively seated within said groove; and e. means for detonating said explosive substance.

2. The device of claim 1 wherein said base member has a substantially flat back surface opposite said juncture with said cap member and said groove is parallel to said back surface.

3. The device of claim 1 wherein said base member has a back surface opposite said juncture with said cap member defining two substantially flat planes intersecting one another at an angle along a line through said back surface.

4. The device of claim 3 wherein a part of said groove is parallel to one of said planes and the remainder of said groove is parallel to the other of said planes.

5. The device of claim 1 wherein said base member has a back surface opposite said juncture with said base member and said groove is located parallel to and a predetermined distance from said back surface.

6. The device of claim 1 wherein said groove is of sufficient depth and width that heat and gases formed therein on detonation of said explosive substance will be constrained and directed in a nozzle-like manner radially outward from said assembly in a fan-like pattern.

7. The device of claim 1 wherein one side of said groove is formed in said base member and the other side is formed in said cap member such that the interior of said groove will be exposed when said cap and base members are disassembled.

8. The device of claim 1 wherein said explosive substance is of a type detonable substantially only by the direct application of an electrical charge and said means for detonating said substance includes means for applying an electrical charge to said substance.

9. The device of claim 8 wherein said assembly includes an insulating member of rigid, shock-resistant, electrically nonconductive material interposed between said base member and said cap member such that said base member and said cap member are electrically separated from one another and said means for applying an electrical charge to said explosive substance comprises means for applying a source of electrical potential to said base member and said cap member respectively.

10. A method for removing accumulated ice from the interior surfaces of a railroad tunnel or other underground cavity comprising the steps of:

a. fastening an explosive device in an underground cavity at a point on the interior surface of said cavity where ice is likely to accumulate;

b. detonating said explosive device, when said ice has accumulated to a thickness sufficient to require removal, thereby producing a quantity of expanding gases and heat; and c. constraining and directing said expanding gases and heat radially outwardly from said exploded device in a fan-like pattern that is substantially parallel to said interior surface, thereby causing accumulated ice to be sheared away from said surface without causing structural damage to said underground cavity.

11. The method of claim 10 wherein said step (a) is performed at an earlier time during the warmer season of the year before there has been any substantial ice accumulation.

* * * * *

UNITED STATES PATENT OFFICE

CERTIFICATE OF CORRECTION

Patent No. 3,951,065 Dated April 20, 1976

Inventor(s) Loren E. Macnab

It is certified that error appears in the above-identified patent and that said Letters Patent are hereby corrected as shown below:

Column 4, line 59, "cup" should read -- cap --.

Column 5, line 43, "bore 80" should read -- bore 90 --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*